US010851570B2

(12) United States Patent
Smith

(10) Patent No.: US 10,851,570 B2
(45) Date of Patent: Dec. 1, 2020

(54) INTERLOCKING HINGE

(71) Applicant: Austin Hardware & Supply, Inc., Lee's Summit, MO (US)

(72) Inventor: Norman Allen Smith, Buford, GA (US)

(73) Assignee: Austin Hardware And Supply, Inc., Lee's Summit, MO (US)

( * ) Notice: Subject to any disclaimer, the term of this patent is extended or adjusted under 35 U.S.C. 154(b) by 0 days.

(21) Appl. No.: 16/454,955

(22) Filed: Jun. 27, 2019

(65) Prior Publication Data

US 2020/0002986 A1 Jan. 2, 2020

Related U.S. Application Data

(60) Provisional application No. 62/691,674, filed on Jun. 29, 2018.

(51) Int. Cl.

*E05D 7/10* (2006.01)
*E05D 11/06* (2006.01)
*E05D 5/12* (2006.01)

(52) U.S. Cl.

CPC ..... *E05D 7/105* (2013.01); *E05D 7/10* (2013.01); *E05D 11/06* (2013.01); *E05D 5/128* (2013.01)

(58) Field of Classification Search

CPC ..... E05D 7/10; E05D 7/1044; E05D 7/105; E05D 7/1016; E05D 11/06

USPC ..... 16/254, 260, 261, 262, 263, 265, 266

See application file for complete search history.

(56) References Cited

U.S. PATENT DOCUMENTS 97,907 A * 12/1869 Gould ..... E05D 7/105 16/266
106,315 A * 8/1870 Browne ..... E05D 7/105 16/266
3,431,591 A * 3/1969 Betso ..... E05D 7/105 16/265
5,481,783 A * 1/1996 Liou ..... B60R 25/066 16/264
5,669,106 A * 9/1997 Daoud ..... E05D 7/105 16/265
6,317,928 B1 * 11/2001 Guillemette ..... E05D 7/1016 16/353
2006/0026795 A1 * 2/2006 Tonelli ..... A45C 13/005 16/221
2008/0235907 A1 * 10/2008 Wayman ..... E05D 7/105 16/361
2014/0173852 A1 * 6/2014 Heninger ..... E05D 7/105 16/375
2018/0371813 A1 * 12/2018 Cherry ..... E05D 11/1071

* cited by examiner

*Primary Examiner* — Jeffrey O'Brien
(74) *Attorney, Agent, or Firm* — Polsinelli PC

(57) ABSTRACT

An interlocking hinge is described. The interlocking hinge includes a first hinge member and a second hinge member. The first hinge member and the second hinge member interlock in a separable engagement.

20 Claims, 10 Drawing Sheets

INTERLOCKING HINGE

CROSS REFERENCE TO RELATED APPLICATION

This application claims the benefit of U.S. Provisional Patent Application 62/691,674 filed Jun. 29, 2018, which is hereby incorporated by reference.

FIELD OF INVENTION

The present invention relates to an interlocking hinge.

SUMMARY

Described herein is an interlocking hinge. The interlocking hinge may be used to provide a hinging movement between a panel and a structure. The interlocking hinge includes a first hinge member and a second hinge member that interlock in a hinging and separable engagement. The first hinge member and the second hinge member interlock in a selectively separable engagement. The first hinge member and the second hinge member rotate or hinge relative to each other, and at a certain point or range in the hinging or rotation, the first hinge member and the second hinge member may be separated. Otherwise, the first hinge member and the second hinge member remain interlocked while providing the hinging or rotating movement. The hinge is well suited for removable panels such as, for examples, doors, closures, hatches, etc., commonly found on structures such as, for example, containers, cabinets, vehicles, utility boxes, service panels, etc.

The interlocking hinge provides hinging movement between, for example, the panel and, for example, the structure, with the additional benefit of having the capability to easily separate the first hinge member from the second hinge member in order to, for example, completely separate the panel from the structure. This allows for the structure to be closed, accessed by opening the panel, and then the structure may be fully opened by removal of the panel. Thus, the interlocking hinge permits hinged opening of the panel and complete removal of the panel by separating the first hinge member and the second hinge member. The interlocking hinge may be used with both vertically oriented structures and horizontally oriented structures.

The panel may be opened to a separation angle, defined or determined by the interlocking hinge, and then the panel may be lifted off of the structure to allow complete removal of the panel from the structure. The panel may be opened to an angle past the separation angle without removing the panel. The panel may be opened to an angle below the separation angle without removing the panel. Thus, the interlocking hinge provides a normal hinging movement with the benefit of being able to remove the panel. The separation angle is the point or range during the opening of the interlocking hinge where the interlocking hinge is configured to permit separation of the first hinge member and the second hinge member. When the panel is at or in the separation angle, the panel may be lifted or pulled causing the interlocking hinge to separate. The panel may also open past the separation angle with the interlocking hinge remaining non-separated. The separation of the interlocking hinge does not require any special tools or the disassembly of the hinge. The user simply rotates the panel to the separation angle and then moves the panel along an axis of rotation formed by the interlocking hinge in a direction to separate the first hinge member and the second hinge member. For example, at the separation angle, the panel may be moved upward to separate the first hinge member and the second hinge member. For example, in other aspects, at the separation angle, the panel may be moved in any direction that separates the first hinge member and the second hinge member.

When the panel is not at the separation angle, structures of the first hinge member and the second hinge member prevent the separation of the first hinge member and the second hinge member, and the first hinge member and the second hinge member remain interlocked. As such, the interlocking hinge may be used in environments that require the panel to be securely fastened or locked. For example, when a panel that incorporates the interlocking hinge is fully closed and secured by a lock, a third party may not remove the panel by separation of the interlocking hinge by merely lifting the panel, as the lock prevents the panel from rotating to the separation angle.

In one aspect, a first hinge member includes one or more protrusions that seat into one or more spaces of a second hinge member while the second hinge member includes one or more protrusions that seat into one or more spaces of the first hinge member to interlock the first hinge member and the second hinge member. The first hinge member and the second hinge member may be rotated to a separation angle, where the one or more protrusions of the first hinge member may be removed from the one or more spaces of the second hinge member while the one or more protrusions of the second hinge member may be removed from the one or more spaces of the first hinge member to separate the first hinge member from the second hinge member. When the first hinge member and the second hinge member are not at the separation angle, the first hinge member and the second hinge member are interlocked together by the respective one or more protrusions seated in the respective one or more spaces.

In another aspect, an interlocking hinge is described. The interlocking hinge includes a first hinge member and a second hinge member. The first hinge member includes a base side and a hinge side. The second hinge member includes a base side and a hinge side. The hinge side of the first hinge member includes a rounded outer surface having ribs, which define one or more spaces. The hinge side of the first hinge member includes one or more protrusions. The hinge side of the second hinge member includes a rounded outer surface having ribs, which define one or more spaces. The hinge side of the second hinge member includes one or more protrusions. The one or more protrusions of the hinge side of the first hinge member seat in the one or more spaces of the hinge side of the second hinge member. The one or more protrusions of the hinge side of the second hinge member seat in the one or more spaces of the hinge side of the first hinge member. The first hinge member and the second hinge member are configured to interlock in a separable engagement.

In another aspect, an interlocking hinge is described. The interlocking hinge includes a first hinge member and a second hinge member. The first hinge member includes a pivot pin. The pivot pin is configured to insert into a central opening of the second hinge member and rotate within the central opening. The first hinge member includes a base side and a hinge side. The second hinge member includes a base side and a hinge side. The hinge side of the first hinge member includes a rounded outer surface having ribs, which define a space. The space receives a protrusion from the hinge side of the second hinge member to interlock the first hinge member and the second hinge member. The hinge side of the second hinge member includes a rounded outer surface having ribs, which define a space. The space receives a protrusion from the hinge side of the first hinge member to interlock the first hinge member and the second hinge member.

In another aspect, an interlocking hinge is described. The interlocking hinge includes a first hinge member and a second hinge member. The first hinge member includes a pivot pin. The pivot pin is configured to insert into a central opening of the second hinge member and rotate within the central opening. The first hinge member includes a base side and a hinge side. The second hinge member includes a base side and a hinge side. The hinge side of the first hinge member includes a rounded outer surface having rib segments, which define spaces between the rib segments. Gaps are formed in between the rib segments. The protrusions from the hinge side of the second hinge member pass through the gaps and into the spaces. The hinge side of the second hinge member includes a rounded outer surface having rib segments, which define spaces between the rib segments. Gaps are formed in between the rib segments. Protrusions from the hinge side of the first hinge member pass through the gaps and into the spaces. The first hinge member and the second hinge member rotate relative to each other. The protrusions from the hinge side of the first hinge member separably interlock into the spaces of the hinge side of the second hinge member. The protrusions from the hinge side of the second hinge member separably interlock into the spaces of the hinge side of the first hinge member.

DETAILED DESCRIPTION OF INVENTION

An interlocking hinge 10 is described. The interlocking hinge 10 includes a first hinge member 100 and a second hinge member 300 that interlock to provide hinging movement with a separable engagement when the first hinge member 100 and the second hinge member 300 are hinged or rotated to a separation angle.

Figure 1:
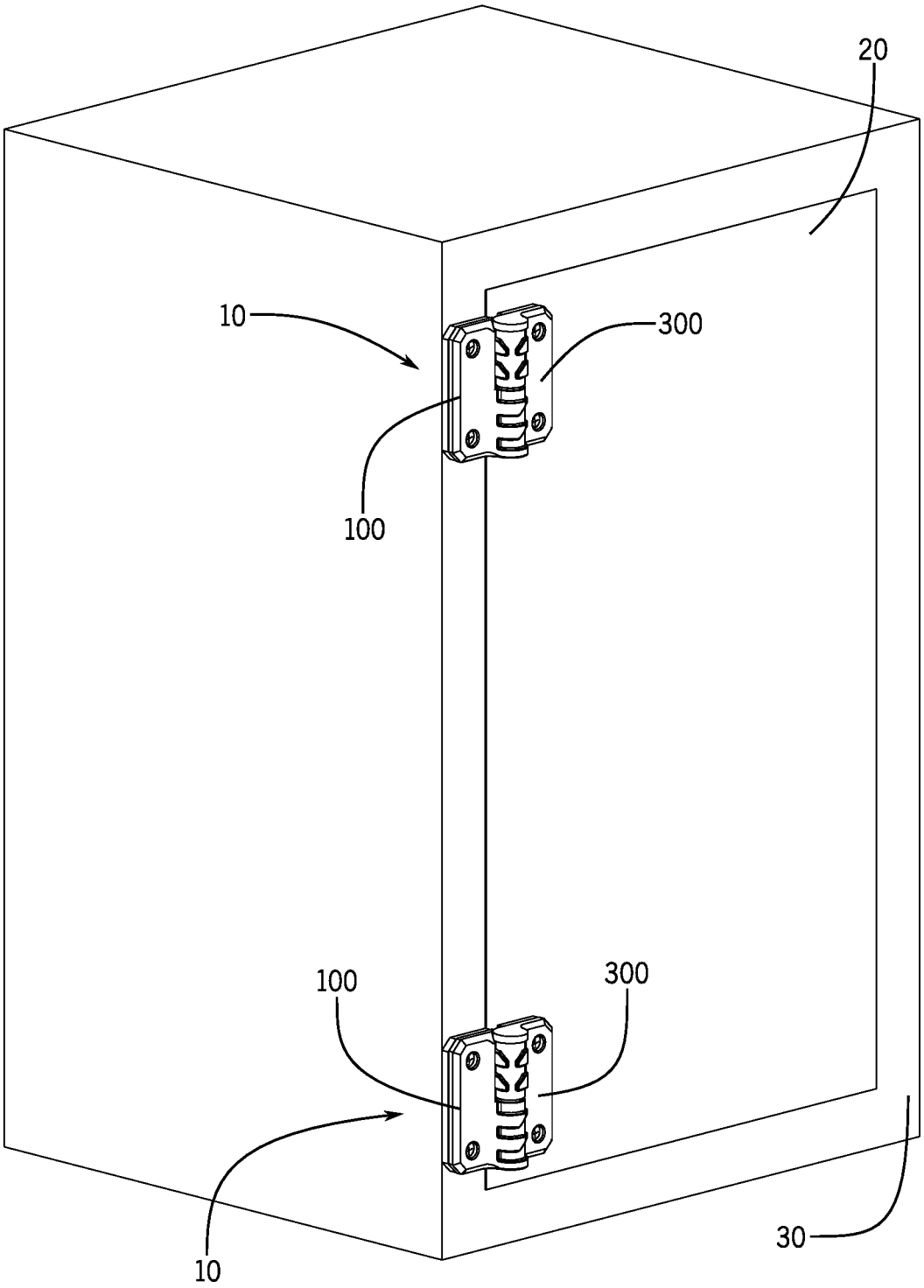
FIG. 1 is a view of a panel hingedly engaged to a vertically oriented structure by the interlocking hinge with the panel in a closed position.
Figure 2:
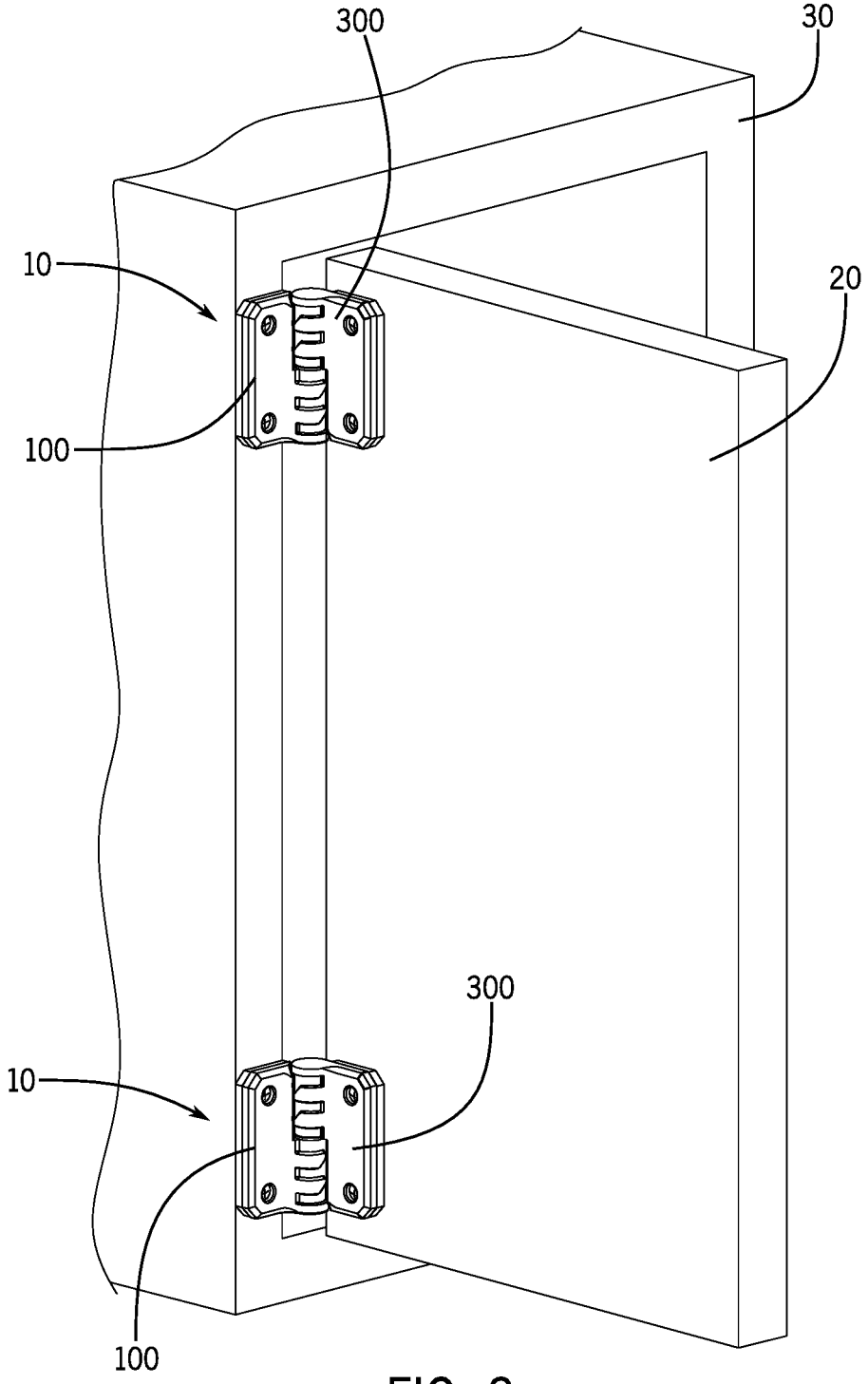
FIG. 2 is a view of the panel hingedly engaged to the vertically oriented structure by the interlocking hinge with the panel in an open position.
Figure 3:
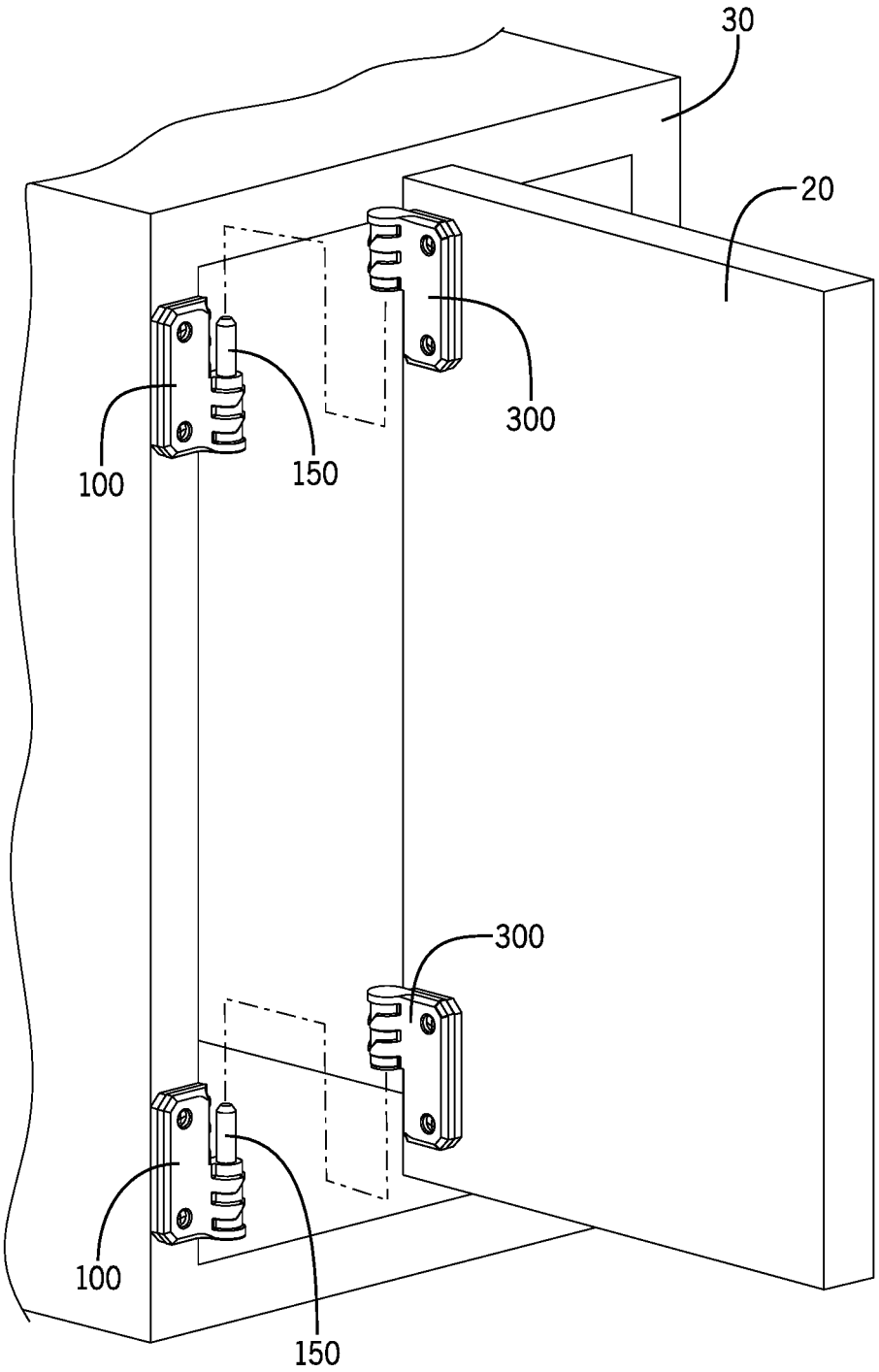
FIG. 3 is a view of the panel of FIGS. 1-2 removed from the vertically oriented structure by separating the interlocking hinge.
Figure 4:
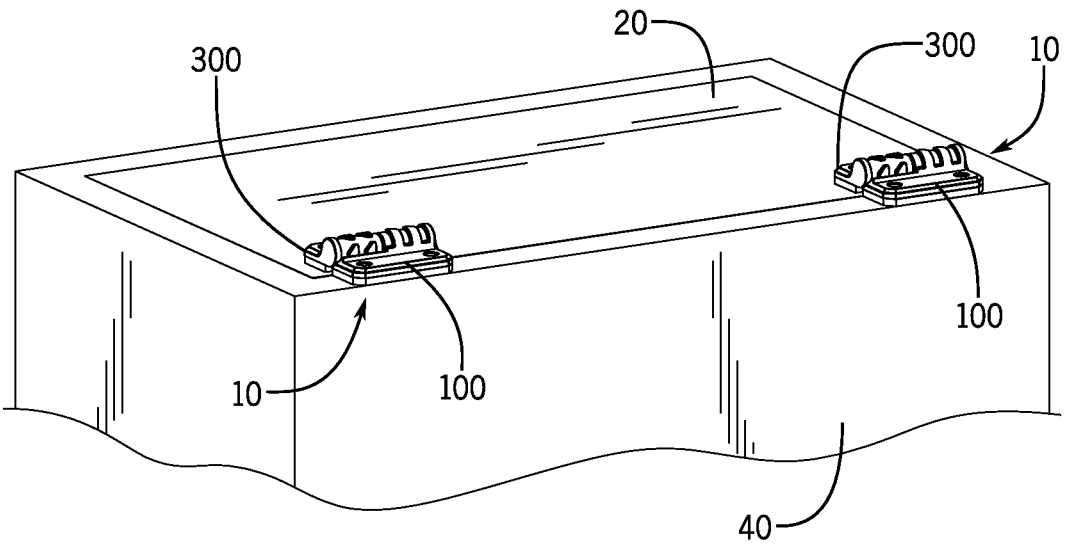
FIG. 4 is a view of a panel hingedly engaged to a horizontally oriented structure by the interlocking hinge with the panel in a closed position.
Figure 5:
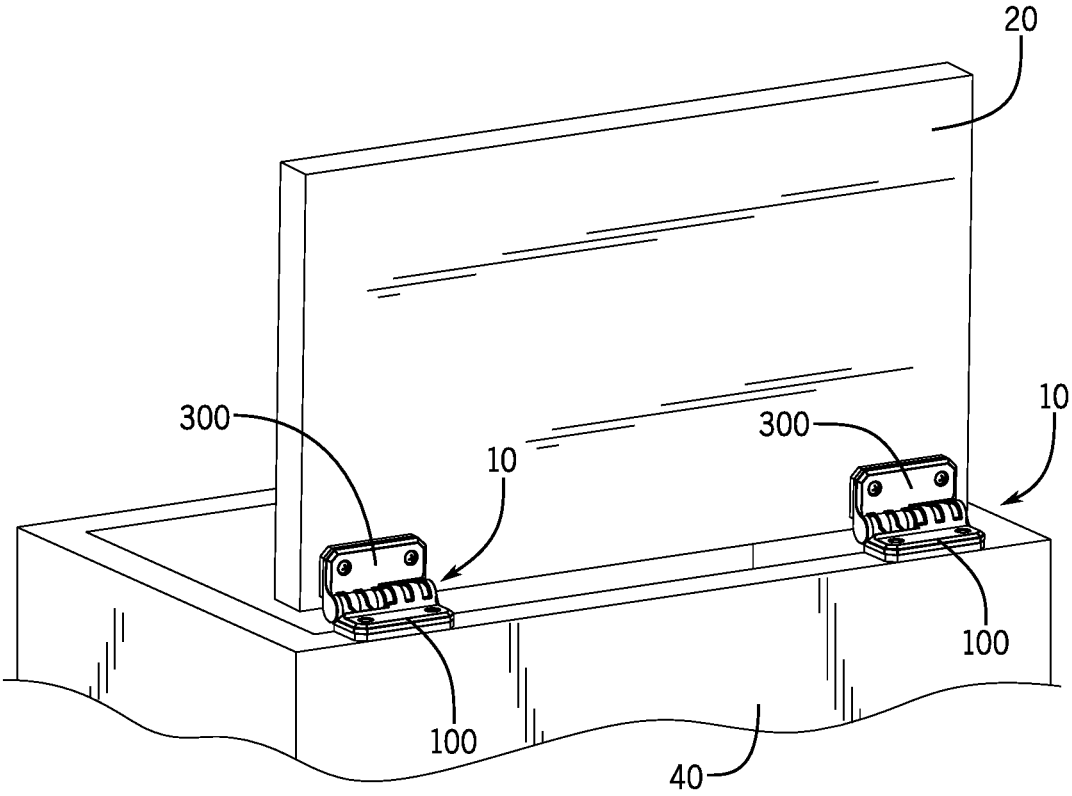
FIG. 5 is a view of the panel hingedly engaged to the horizontally oriented structure by the interlocking hinge with the panel in an open position.
Figure 6:
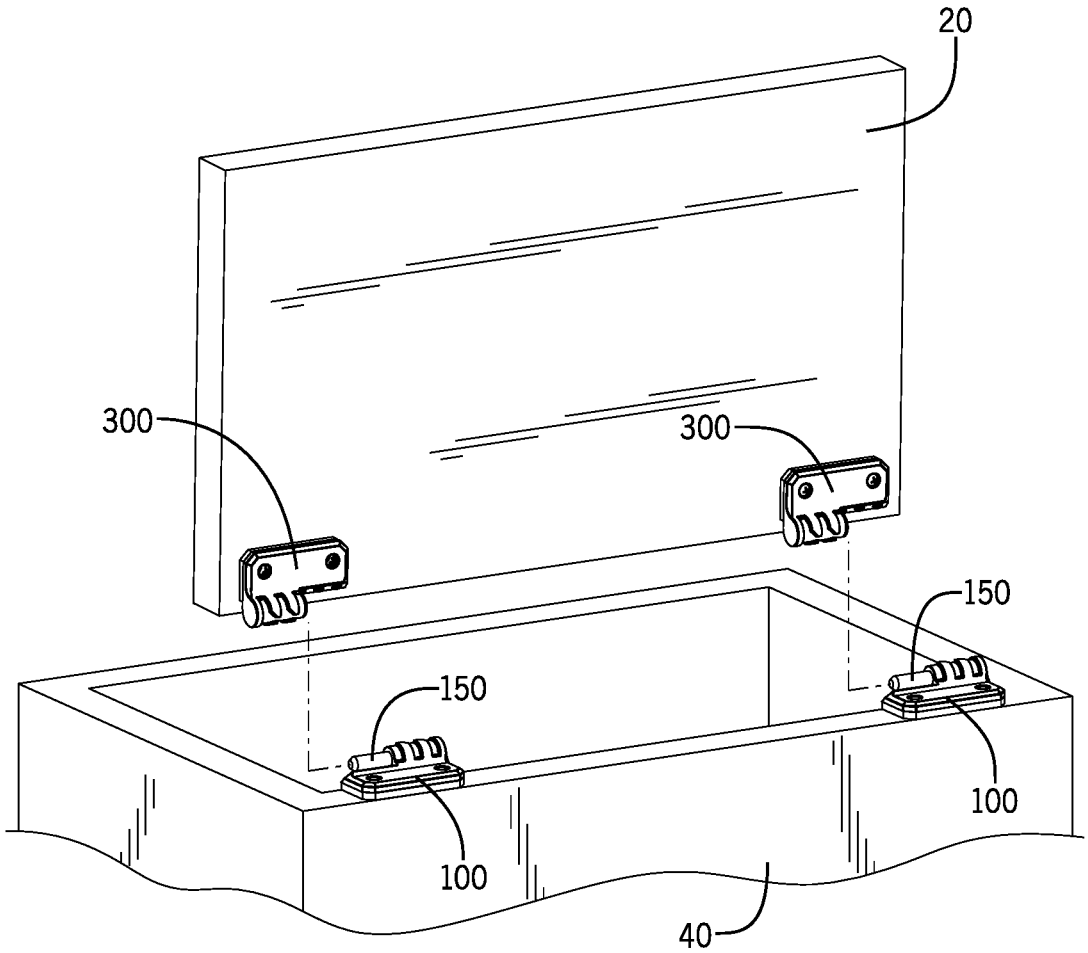
FIG. 6 is a view of the panel of FIGS. 4-5 removed from the horizontally oriented structure by separating the interlocking hinge.

With reference to FIGS. 1-3, the interlocking hinge 10 is used with a vertically oriented structure 30. With reference to FIGS. 4-6, the interlocking hinge 10 is used with a horizontally oriented structure 40.

Figure 7:
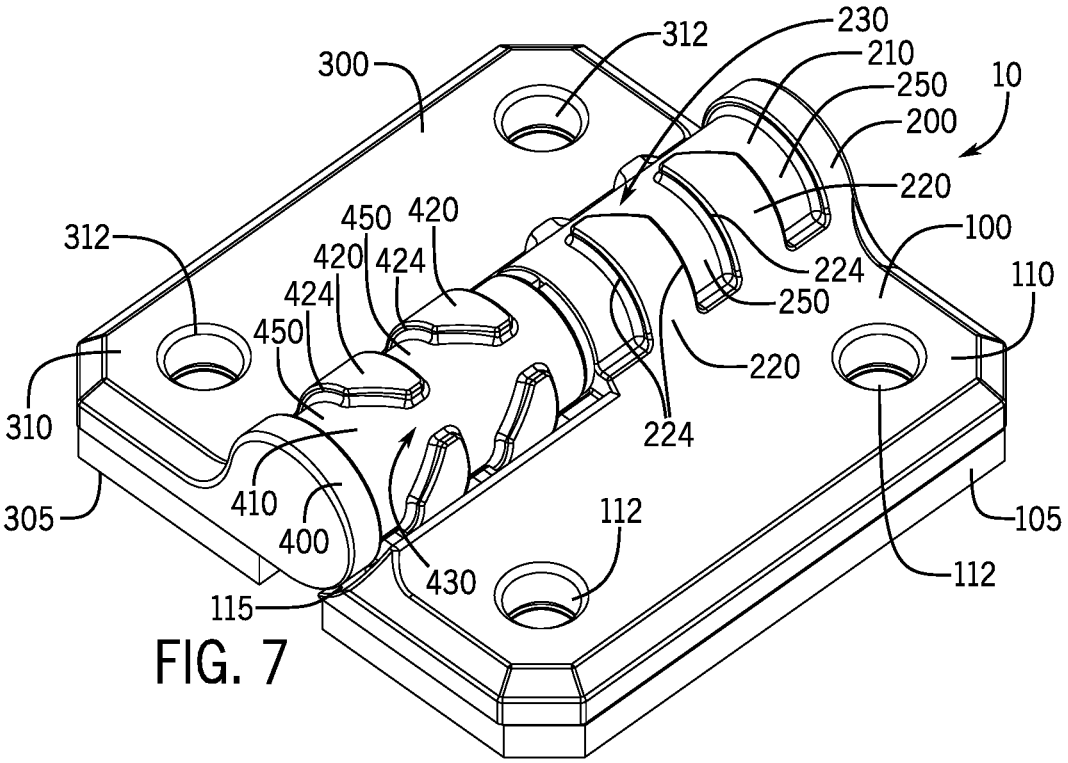
FIG. 7 is a perspective view of the interlocking hinge.
Figure 8:
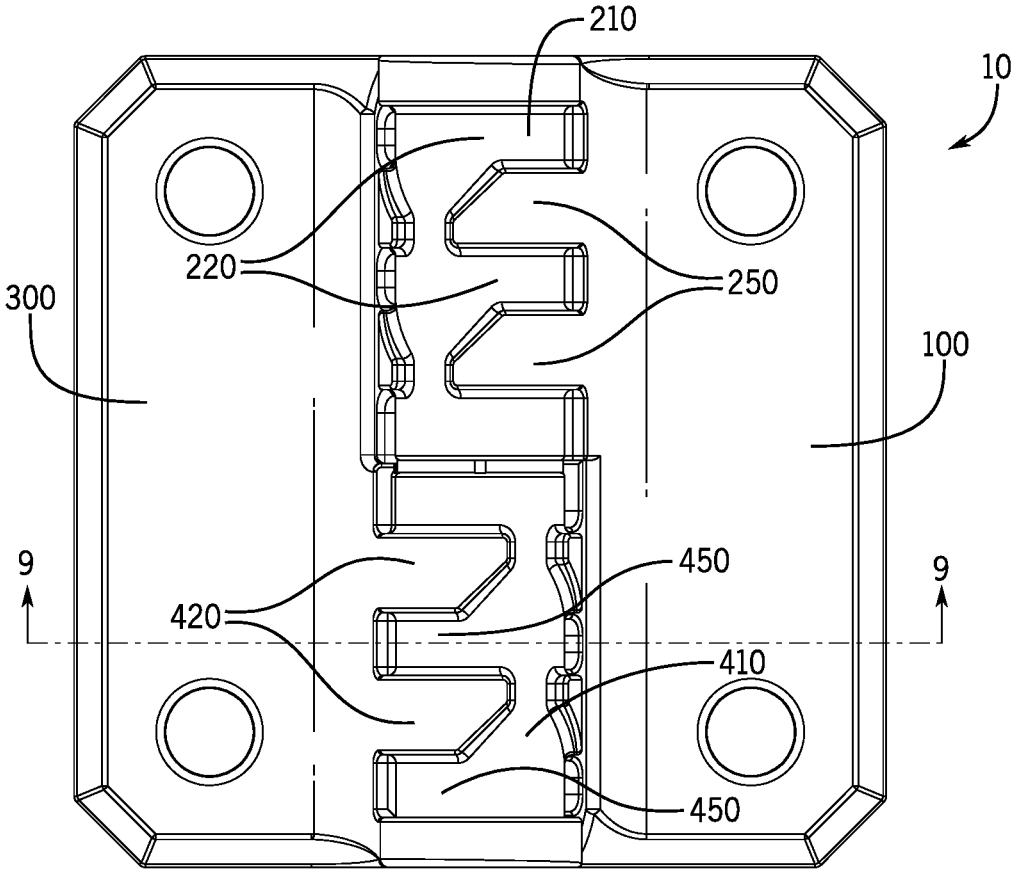
FIG. 8 is a top view of the interlocking hinge.
Figure 9:
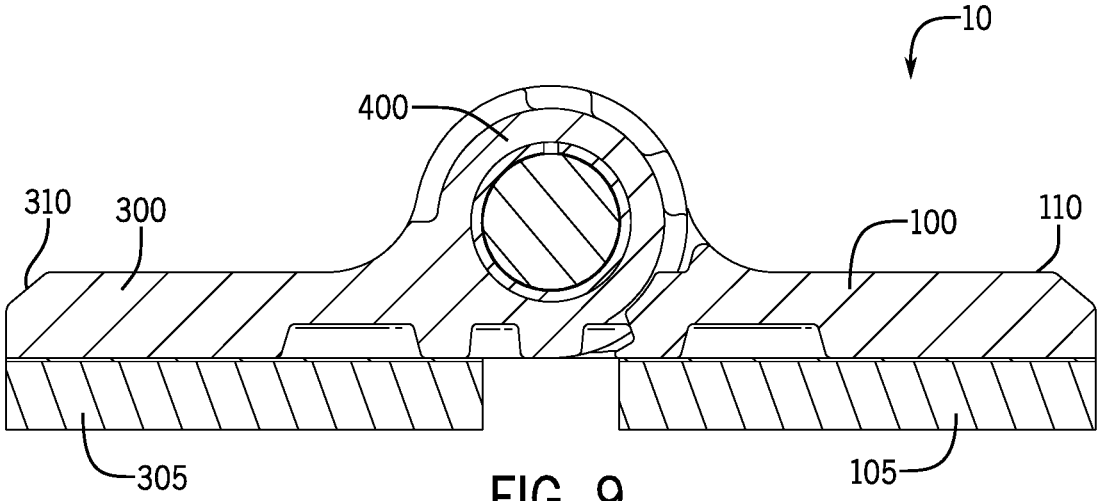
FIG. 9 is an end sectional view of the interlocking hinge.
Figure 10:
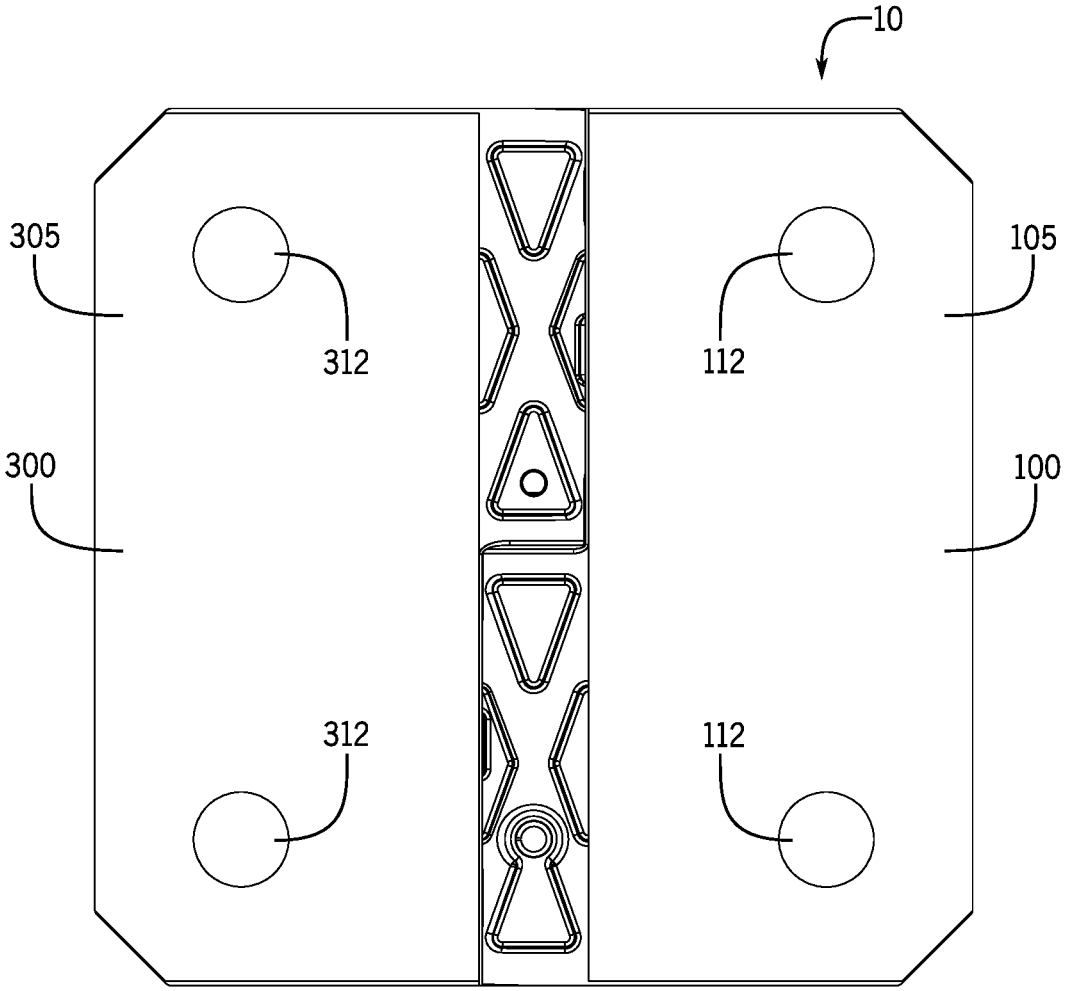
FIG. 10 is a rear view of the interlocking hinge.

With reference to FIG. 7, the first hinge member 100 includes a base side 110 and a hinge side 200, and the second hinge member 300 includes a base side 310 and a hinge side 400. One of the base sides 110, 310 connects to a panel 20, such as, for example, a door, closure, hatch, etc., while the other of the base sides 110, 310 connects to the structure 30 or 40, such as, for example, a container, cabinet, vehicle, utility box, service panel, etc. Each of the base sides 110, 310 may include one or more openings 112, 312, respectively, to receive fasteners that pass through the base sides 110, 310 of the hinge members 100, 300 in order to engage the hinge members 100, 300 to the respective substrate, i.e., the panel 20 or the structure 30 or 40. In other aspects, the base sides 110, 310 may directly connect to the respective substrate via welding, adhesives, integral formation, etc. The base sides 110, 310 may engage to a frame of a cabinet. The base sides 110, 310 may be shaped or configured to engage to an extruded side section of a frame.

The hinge side 200 of the first hinge member 100 hingedly engages with the hinge side 400 of the second hinge member 300. The hinge sides 200 and 400 hingedly engage to each other or interlock in a separable manner. When the first hinge member 100 and the second hinge member 300 are hinged or rotated to the separation angle, the first hinge member 100 and the second hinge member 300 may be separated.

In the aspect shown, the first hinge member 100 includes a pivot pin 150. The pivot pin 150 forms an axis of rotation for the hinge 10. The pivot pin 150 is held in a fixed, non-rotatable engagement by the first hinge member 100. When the hinge members 100 and 300 are joined, the pivot pin 150 inserts into a central opening 460 of the hinge side 400 of the second hinge member 300. The pivot pin 150 rotates within the central opening 460 as the hinge members 100 and 300 rotate relative to each other. Of course, one of ordinary skill in the art will recognize that a reverse configuration is within the scope of the present disclosure, wherein the second hinge 300 may be configured to hold the pivot pin 150.

The central opening 460 of the hinge side 400 of the second hinge member 300 may include or be formed by a bushing 470. In the aspect shown, the bushing 470 inserts into the central opening 460, and the pivot pin 150 inserts into an opening 472 of the bushing 470. The bushing 470 is generally fixed relative to the hinge side 400. For example, the bushing 470 may include a detent, groove, ridge, etc. that locks the bushing 470 into place in the central opening 460 of the hinge side 400.

In the aspect shown, the interlocking hinge 10 will separate (or assemble) when there is an approximately 85 degree angle to an approximately 95 degree angle between the hinge members 100 and 300. At these angles, the hinge members 100 and 300 may be separated. In this aspect, the approximately 85 degree to approximately 95 degree angle is the separation angle. The hinge members 100 and 300 will remain interlocked below approximately 85 degrees and above approximately 95 degrees. In the aspect shown, the interlocking hinge 10 will open up to approximately 180 degrees. In other aspects, the construction of the hinge members 100 and 300 may be modified to adjust the separation angle to a different range, a larger range, or a smaller range. Notably, even at the separation angle, the hinge members 100 and 300 will not automatically or immediately separate—as a separation force is still required to separate the hinge members. With reference to FIGS. 1-3, the interlocking hinge 10 is used with the vertically oriented structure 30, and the panel 20 must be rotated to the separation angle and then lifted upward to separate the hinge members 100 and 300. In this aspect, the lifting upward of the panel 20 provides the separation force. Thus, the interlocking hinge 10 provides for normal hinging movement of the panel 20 with added benefit of removability. In other aspects, the separation force may be provided in a direction parallel to an axis of rotation of the hinge members 100 and 300.

Figure 12:
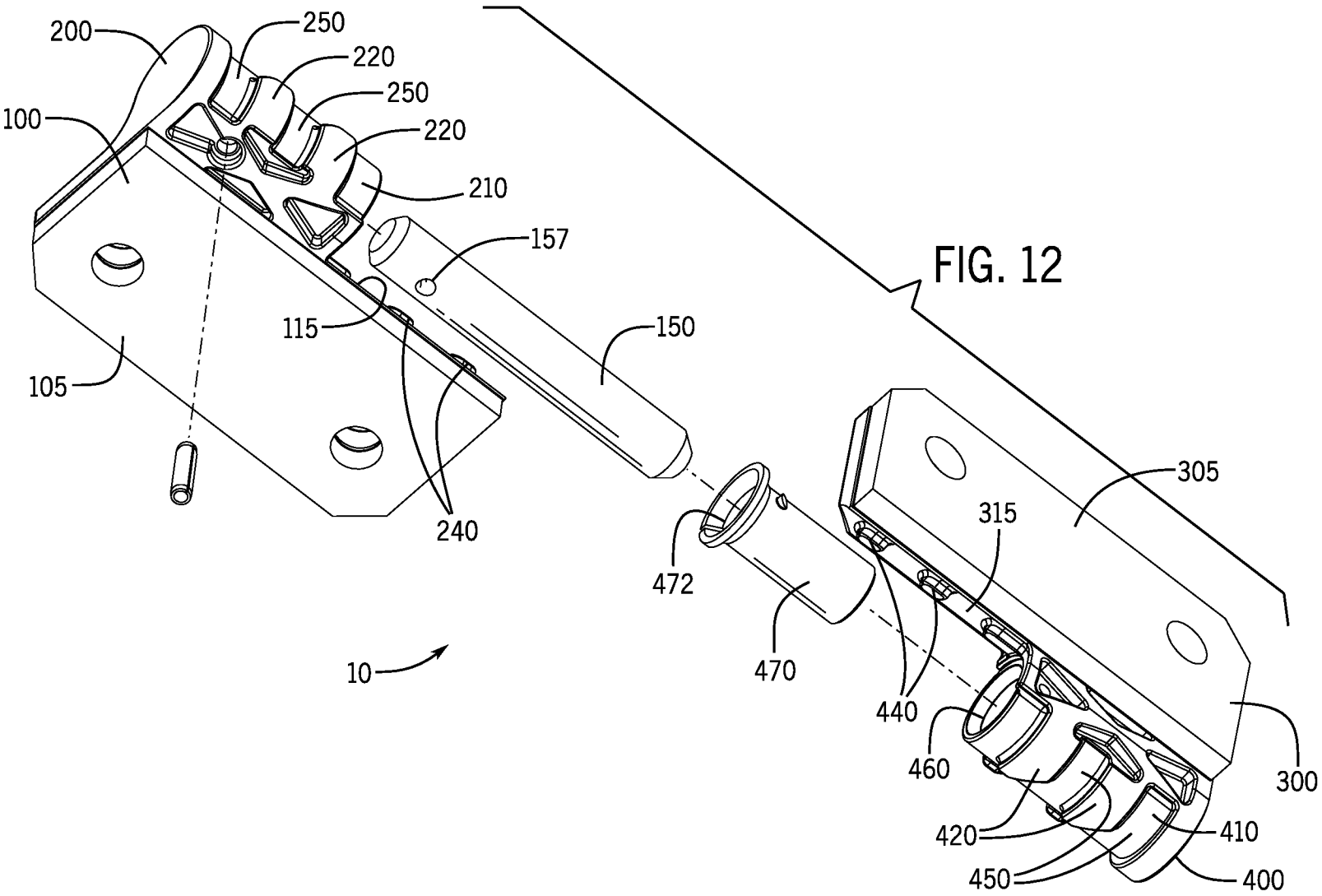
FIG. 12 is an exploded view of the interlocking hinge.

The hinge sides 200 and 400 will now be described in greater detail. Each of the hinge side 200 and 400 include a rounded outer surfaces 210, 410, respectively, having one or more ribs 220, 420, respectively, which define spaces 250, 450, respectively, that receive protrusions 240, 440, respectively, from the other hinge side 200 or 400. The protrusions 240 and 440 are shown in FIG. 12. The spaces 250 are formed in between the ribs 220, and the spaces 450 are formed in between the ribs 420. The one or more ribs 220 and 420 project from the rounded outer surface 210, 410, respectively. The one or more ribs 220 and 420 include walls 224 and 424 extending from the rounded outer surfaces 210, 410.

The spaces 250, 450 may also include a groove shape. The one or more ribs 220 and 420 and the spaces 250, 450 form a track or pathway that receives the protrusions 240, 440.

The protrusions 240, 440 are positioned on outer surfaces 115, 315 of the respective base side 110, 310. The protrusions 240, 440 may extend outwardly from the outer surfaces 115, 315 of the respective base side 110, 310. The outer surfaces 115, 315 form a curved or arcuate surface with a curvature approximately matching the rounded outer surface 210, 410. In the aspect shown, each outer surface 115, 315 includes three protrusions 240, 440, although other aspects may include fewer or additional protrusions 240, 440.

The hinge sides 200 and 400 are positioned on an inner side of both the first hinge member 100 and second hinge member 300. The outer surfaces 115, 315 of with the protrusions 240, 440 are also positioned on the same inner side of both the first hinge member 100 and second hinge member 300. When the first hinge member 100 and the second hinge member 300 are joined, the hinge sides 200 and 400 are aligned.

In this aspect, the rounded outer surfaces 210, 410 of each of the hinge side 200 and 400 form a convex or rounded surface, while the outer surfaces 115, 315 of each of the base side 110, 310 form a concave surface. The rounded outer surfaces 210, 410 and the outer surfaces 115, 315 may rotatably engage each other. The rounded outer surfaces 210, 410 and the outer surfaces 115, 315 are complementary in shape, with the convex shape of the rounded outer surfaces 210, 410 rotating closely to the convex shape of the outer surfaces 115, 315.

The ribs 220 and 420 are formed of multiple rib segments with a gap 230, 430 or space positioned between the segments. As described below, the gaps 230, 430 or spaces allow for the hinge 10 to separate and assemble in an interlocking engagement. During assembly, the protrusions 240, 440 pass through the gaps 230, 430 allowing the pivot pin 150 to fully seat in the opening 472 of the bushing 470. During assembly, the pivot pin 150 enters the opening 472 as the pivot pin 150 moves parallel to an axis of rotation of the hinge 10. The gaps 230 are aligned in the same plane generally parallel to the axis of rotation of the hinge 10, and the gaps 430 are also aligned in their own same plane generally parallel to the axis of rotation of the hinge 10.

Figure 11:
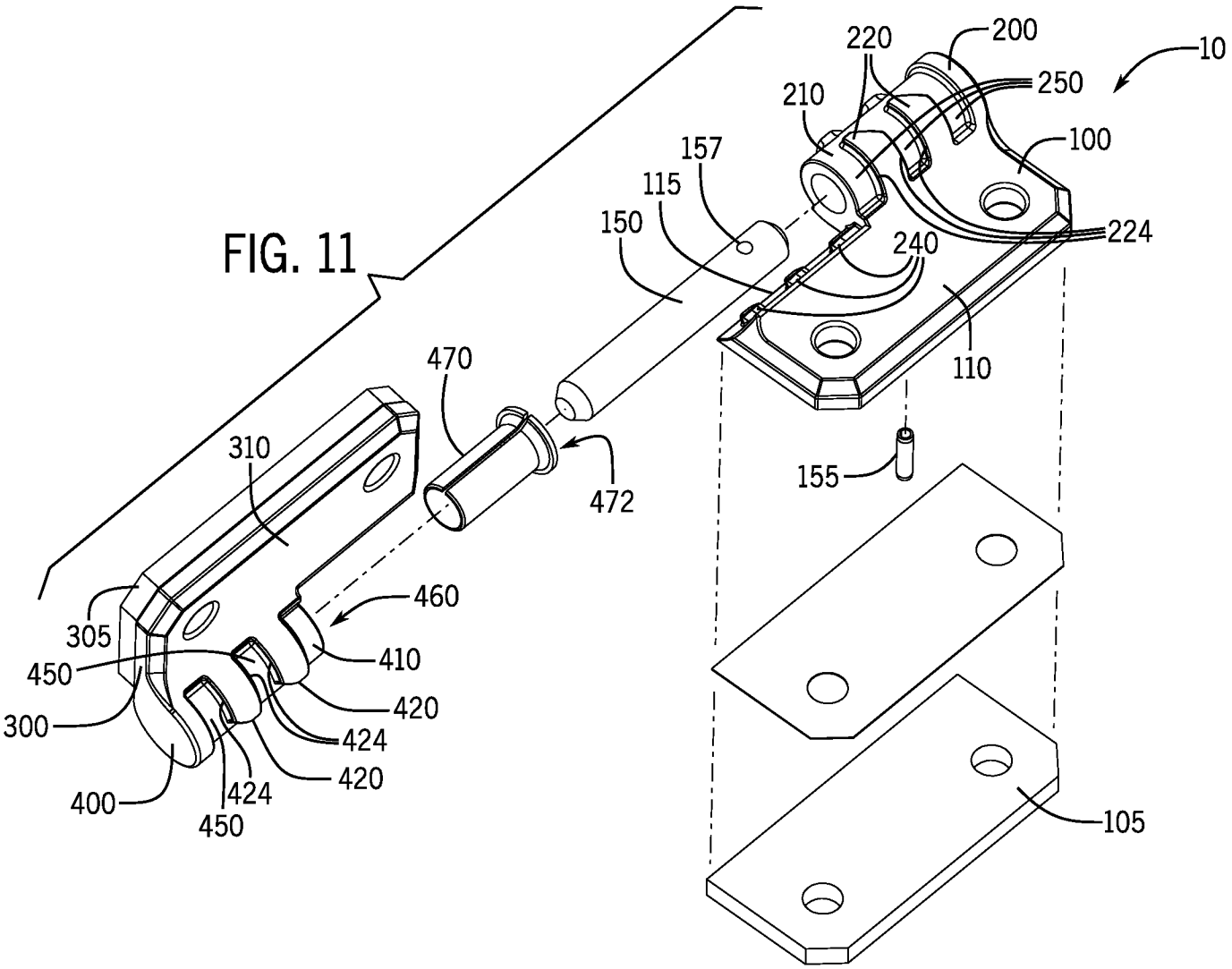
FIG. 11 is an exploded view of the interlocking hinge.

With reference to FIG. 11, the first hinge member 100 includes the base side 110 and the hinge side 200, and the second hinge member 300 includes the base side 310 and the hinge side 400. In this aspect, the hinges sides 200 and 400 are integrally formed with the base sides 110 and 310, respectively. The protrusions 240, 440 are positioned on the outer surfaces 115, 315 of the base sides 110, 310 and extend toward the axis of rotation of the hinge 10. The protrusions 240, 440 and the hinge sides 200 and 400 are positioned on a same side of the first hinge member 100 and second hinge member 300, respectively. The protrusions 240, 440 are positioned on the outer surfaces 115, 315 of the base sides 110, 310 in-line with the hinge sides 200 and 400. The hinge sides 200 and 400 include a generally cylindrical shape with the rounded outer surfaces 210, 410. The hinge sides 200 and 400 extend from the base sides 110 and 310. In this aspect, the hinge sides 200 and 400 form approximately one-half of a length of the base sides 110 and 310, while the outer surfaces 115, 315 form the remaining approximately one-half of the length of the base sides 110 and 310. The specific lengths of the hinge sides 200 and 400 and the outer surfaces 115, 315 may be changed depending upon the application and working requirements of the hinge 10.

The one or more ribs 220, 420 are positioned or formed on the rounded outer surfaces 210, 410 of the hinge side 200 and 400. When the hinge members 100 and 300 are joined, the protrusions 240, 440 are held in the spaces 250, 450. With reference to the first hinge member 100, the protrusions 240 extend from the outer surface 115 in the direction of the pivot pin 150. With reference to FIG. 11, the pivot pin 150 is held in a fixed, non-rotatable engagement by the hinge side 200 of the first hinge member 100.

Figure 13:
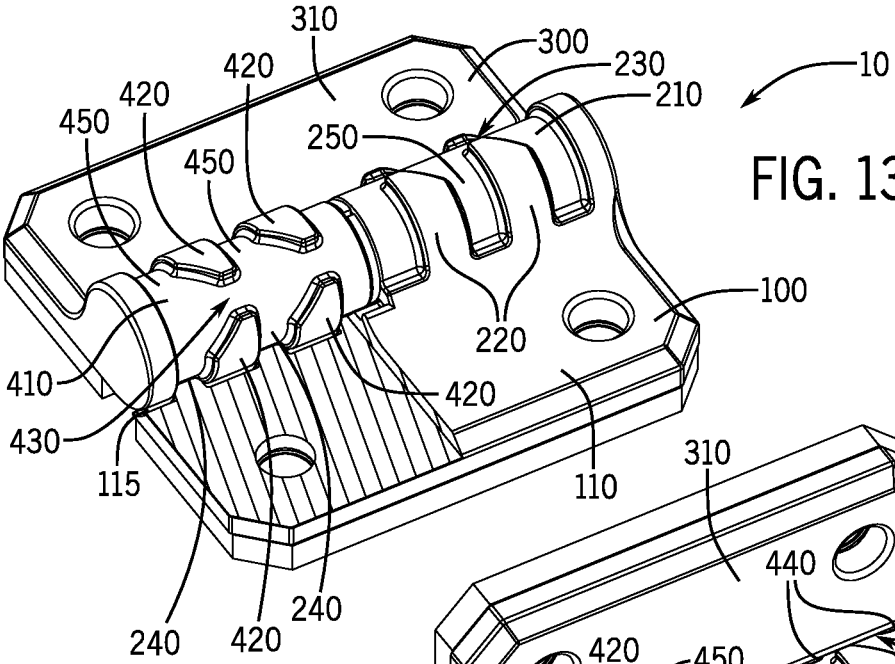
FIG. 13 is a perspective view of the interlocking hinge in the closed position.
Figure 14:
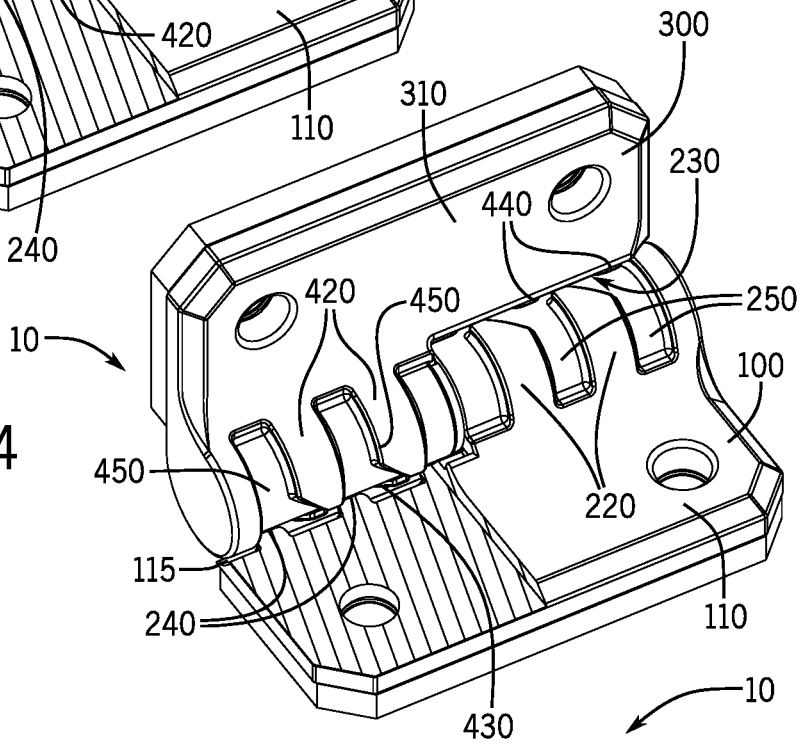
FIG. 14 is a perspective view of the interlocking hinge in the open position.
Figure 15:
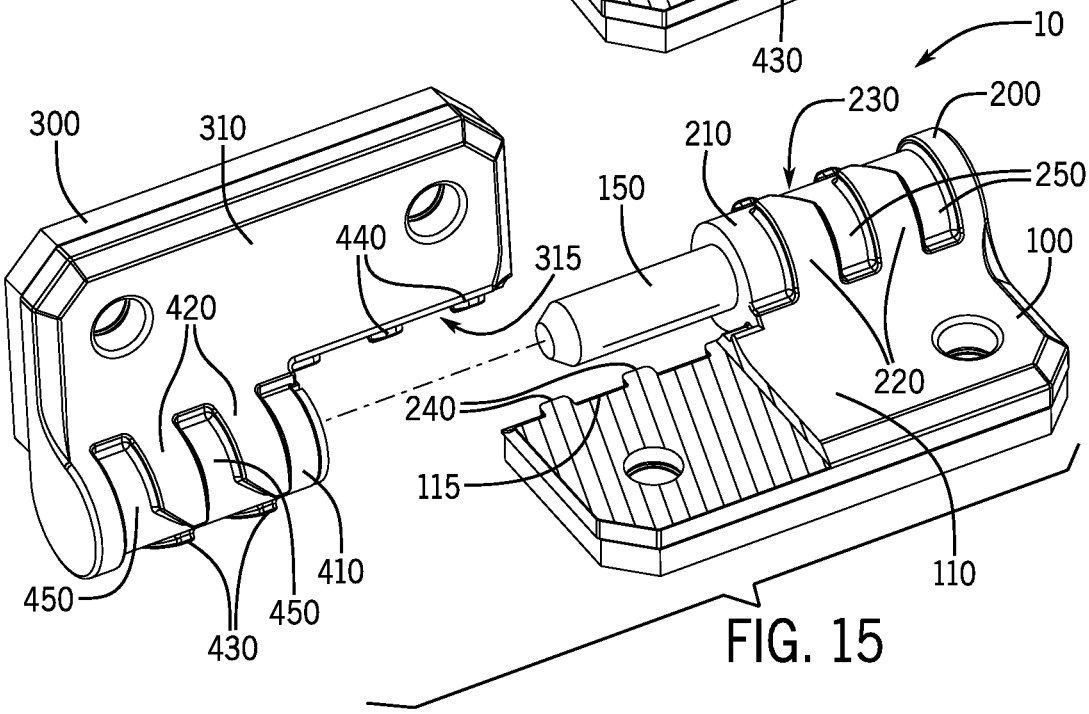
FIG. 15 is a perspective view of the interlocking hinge with the first hinge member separated from the second hinge member.

FIGS. 13-15 show the disassembly of the hinge 10. In FIG. 13, the hinge 10 is in a fully open position. The protrusions 240 are positioned in the spaces 450 formed in between the ribs 420, and the protrusions 440 are positioned in the spaces 250 formed in between the ribs 220. This prevents the separation of the hinge members 100 and 300. In FIG. 14, the hinge 10 is moved to the separation angle, which aligns the protrusions 240 with the gaps 430 and aligns the protrusions 440 with the gaps 230. In FIG. 15, the hinge members 100 and 300 have been separated.

During assembly, the hinges sides 200 and 400 of the hinge members 100 and 300 are brought together. The hinge members 100 and 300 are aligned with the pivot pin 150 directed towards the opening 472. The pivot pin 150 enters the opening 472 as the pivot pin 150 moves parallel to an axis of rotation of the hinge 10. The protrusions 240 of the outer surface 115 of the base side 110 of the first hinge member 100 pass through the gaps 430 of the hinge side 400 of the second hinge member 300, and the protrusions 240 seat in the spaces 450. Meanwhile, on the opposite end of the hinge 10, the protrusions 440 of the outer surface 315 pass through the gaps 230 of the hinge side 200 of the first hinge member 100. The protrusions 440 seat in the spaces 250. The hinge side 200 is now rotatably engaged to the outer surface 315 and the hinge side 400 is now rotatably engaged to the outer surface 115. Once the protrusions 240, 440 are seated in the spaces 450, 250, the hinge members 100 and 300 may now be rotated. The ribs 220 and 420 limit movement of the protrusions 240, 440 to the spaces 250, 450. The protrusions 240, 440 may rotate or slide in the spaces 250, 450. After the protrusions 240, 440 rotate out of the gaps 230, 430 and into a length of the spaces 250, 450, the hinge members 100 and 300 are now interlocked and cannot normally be separated (absent destructive techniques). The walls 224 and 424 of the one or more ribs 220 and 420 maintain the protrusions 240, 440 to the spaces 250, 450.

The length of the spaces 250 and 450 may extend around the hinge sides 200 and 400 in range of approximately 180 degrees to approximately 270 degrees, although these ranges may be adjusted depending upon the application and specific working requirements of the hinge 10.

In order to separate the hinge members 100 and 300, the hinge members 100 and 300 are rotated or hinged to the separation angle where the protrusions 240, 440 are aligned with the gaps 430, 230, and then the hinge members 100 and 300 may be lifted or otherwise pulled apart, as the protrusions 240 are free to pass through the gaps 430 and the protrusions 440 are free to pass through the gaps 230. The gaps 230, 430 are aligned generally parallel to the axis of rotation of the hinge 10. At the separation angle, the hinge members 100 and 300 may be pulled apart or otherwise separated.

The ribs 220 and 420 may have an angled face to align the respective protrusions 240, 440 into the respective space 250, 450. The spaces 250, 450 are lined by the walls 224 and 424 of the ribs 220 and 420. The walls 224 and 424 direct or control the movement of the protrusions 240, 440. The walls 224 and 424 confine the rotation movement of the protrusions 240, 440.

The pivot pin 150 generally forms the axis of rotation for the hinge 10. The ribs 220 and 420 are oriented in a generally perpendicular direction to the axis of rotation of the hinge 10. The spaces 250, 450 defined by the ribs 220 and 420 are oriented in a generally perpendicular direction to the axis of rotation of the hinge 10. The spaces 250, 450 are formed on an exterior of the rounded outer surface 210, 410.

Each of the first hinge member 100 and the second hinge member 300 may include a substantially identical housing, while one of the first hinge member 100 or the second hinge member 300 includes the pivot pin 150 and the other of the first hinge member 100 or the second hinge member 300 receives the pivot pin 150.

With respect to FIG. 11, a rear surface of the first hinge member 100 and the second hinge member 300 may include gasket 105 and 305. Also, a pin 155 may be used to secure the pivot pin 150. The pin 155 may pass through the hinge side 200 of the first hinge member 100 and into an opening 157 of the pivot pin 150 to hold the pivot pin 150.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. An interlocking hinge, comprising:

a first hinge member;

a second hinge member;

the first hinge member includes a base side and a hinge side, and the second hinge member includes a base side and a hinge side;

the hinge side of the first hinge member includes a first rounded outer surface having first ribs protruding outwardly from the first rounded outer surface, the first ribs define one or more first spaces;

the hinge side of the first hinge member includes one or more first protrusions;

the hinge side of the second hinge member includes a second rounded outer surface having second ribs protruding outwardly from the second rounded outer surface, the second ribs define one or more second spaces;

the hinge side of the second hinge member includes one or more second protrusions;

the one or more first protrusions of the hinge side of the first hinge member seat in the one or more second spaces of the hinge side of the second hinge member;

the one or more second protrusions of the hinge side of the second hinge member seat in the one or more first spaces of the hinge side of the first hinge member; and wherein the first hinge member and the second hinge member are configured to interlock in a separable engagement.

2. The interlocking hinge according to claim 1, wherein the first hinge member includes a pivot pin, the pivot pin configured to insert into a central opening of the second hinge member and rotate within the central opening.

3. The interlocking hinge according to claim 1, wherein the interlocking hinge is configured to be separated or assembled when there is an approximately 85 degree to approximately 95 degree angle between the first hinge member and the second hinge member.

4. The interlocking hinge according to claim 1, wherein the interlocking hinge is configured to be separated or assembled when the first hinge member and the second hinge member are oriented at a separation angle, and the interlocking hinge is prevented from being separated or assembled when the first hinge member and the second hinge member are oriented at an angle less than or greater than the separation angle.

5. The interlocking hinge according to claim 1, wherein the first and second ribs are oriented substantially circumferentially about an axis of rotation of the hinge, and the one or more first and second spaces are oriented substantially circumferentially about the axis of rotation of the hinge.

6. The interlocking hinge according to claim 1, wherein the hinge side of the first hinge member includes at least two first protrusions and at least two first spaces, and wherein the hinge side of the second hinge member includes at least two second protrusions and at least two second spaces.

7. The interlocking hinge according to claim 6, wherein the at least two first protrusions of the hinge side of the first hinge member seat in the at least two second spaces of the second hinge member, and wherein the at least two second protrusions of the hinge side of the second hinge member seat in the at least two first spaces of the first hinge member.

8. The interlocking hinge according to claim 1, wherein the first ribs of the first hinge member include first rib segments, and a first gap separates the first rib segments, wherein the one or more second protrusions of the second hinge member pass through the first gap.

9. The interlocking hinge according to claim 8, wherein the one or more second protrusions of the second hinge member pass through the first gap and into the one or more first spaces of the first hinge member to interlock the first hinge member with the second hinge member.

10. The interlocking hinge according to claim 1, wherein the first ribs of the first hinge member and the second ribs of the second hinge member include first and second rib segments, and first and second gaps separate the first and second rib segments.

11. The interlocking hinge according to claim 1, the one or more first protrusions of the hinge side of the first hinge member separably interlock into the one or more second spaces of the hinge side of the second hinge member; and, the one or more second protrusions of the hinge side of the second hinge member separably interlock into the one or more first spaces of the hinge side of the first hinge member.

12. A structure with a panel comprising the interlocking hinge member according to claim 1, wherein the first hinge member is attached to the structure and the second hinge member is attached to the panel.

13. The structure according to claim 12, wherein the panel is completely separable from the structure by separating the first hinge member and the second hinge member.

14. An interlocking hinge, comprising:

a first hinge member;

a second hinge member;

the first hinge member includes a pivot pin, the pivot pin configured to insert into a central opening of the second hinge member and rotate within the central opening;

the first hinge member includes a base side and a hinge side, and the second hinge member includes a base side and a hinge side; and, wherein the hinge side of the first hinge member includes a first rounded outer surface having first ribs protruding outwardly from the first rounded outer surface, the first ribs define a first space, and the first space receives a second protrusion from the hinge side of the second hinge member to interlock the first hinge member and the second hinge member; and wherein the hinge side of the second hinge member includes a second rounded outer surface having second ribs protruding outwardly from the second rounded outer surface, the second ribs define a second space, and the second space receives a first protrusion from the hinge side of the first hinge member to interlock the first hinge member and the second hinge member.

15. The interlocking hinge according to claim 14, wherein the interlocking hinge is configured to be separated or assembled when the first hinge member and the second hinge member are oriented at a separation angle, and the interlocking hinge is prevented from being separated or assembled when the first hinge member and the second hinge member are oriented at an angle less than or greater than the separation angle.

16. The interlocking hinge according to claim 14, wherein the first protrusion from the hinge side of the first hinge member separably interlocks into the second space of the hinge side of the second hinge member; and the second protrusion from the hinge side of the second hinge member separably interlocks into the first space of the hinge side of the first hinge member.

17. The interlocking hinge according to claim 14, wherein the pivot pin forms an axis of rotation for the hinge, the first and second ribs are oriented substantially circumferentially about the axis of rotation of the hinge, and the first and second spaces are oriented substantially circumferentially about the axis of rotation of the hinge.

18. The interlocking hinge according to claim 14, wherein the first hinge member and the second hinge member are configured to rotate relative to each other, and the first and second ribs limit movement of the first and second protrusions to the first and second spaces.

19. A structure with a panel comprising the interlocking hinge member according to claim 14, wherein the first hinge member is attached to the structure and the second hinge member is attached to the panel.

20. An interlocking hinge, comprising:

a first hinge member;

a second hinge member;

the first hinge member includes a pivot pin, the pivot pin configured to insert into a central opening of the second hinge member and rotate within the central opening;

the first hinge member includes a base side and a hinge side, and the second hinge member includes a base side and a hinge side;

wherein the hinge side of the first hinge member includes a first rounded outer surface having first rib segments protruding outwardly from the first rounded outer surface, the first rib segments define first spaces between the first rib segments, wherein first gaps are formed in between the first rib segments, and second protrusions from the hinge side of the second hinge member pass through the first gaps and into the first spaces;

wherein the hinge side of the second hinge member includes a second rounded outer surface having second rib segments protruding outwardly from the second rounded outer surface, the second rib segments define second spaces between the second rib segments, wherein second gaps are formed in between the second rib segments, and first protrusions from the hinge side of the first hinge member pass through the second gaps and into the second spaces;

wherein the first hinge member and the second hinge member rotate relative to each other;

the first protrusions from the hinge side of the first hinge member separably interlock into the second spaces of the hinge side of the second hinge member; and, the second protrusions from the hinge side of the second hinge member separably interlock into the first spaces of the hinge side of the first hinge member.

* * * * *